United States Patent [19]

Hobson

[11] 4,081,122

[45] Mar. 28, 1978

[54] COMBINED ICE TRAY EGG CARTON

[76] Inventor: John S. Hobson, 64 Upper Mountain Ave., Montclair, N.J. 07042

[21] Appl. No.: 713,839

[22] Filed: Aug. 12, 1976

[51] Int. Cl.[2] ..... B65D 1/00

[52] U.S. Cl. ..... 229/2.5 EC; 249/127

[58] Field of Search ..... 229/2.5 EC, 29 M; 249/127, 130, 69

[56] References Cited

U.S. PATENT DOCUMENTS

| | | | |
|---|---|---|---|
| D. 142,118 | 8/1945 | Parsons et al. | 229/29 M UX |
| 1,173,114 | 2/1916 | Lane | 229/29 M UX |
| 1,990,145 | 2/1935 | Swift, Jr. | 229/29 M X |
| 2,587,852 | 3/1952 | Jahn et al. | 249/130 |
| 3,159,985 | 12/1964 | Keighley | 249/127 X |
| 3,346,171 | 10/1967 | Baker | 229/29 M X |
| 3,519,189 | 7/1970 | Bambara et al. | 229/2.5 EC |
| 3,620,497 | 11/1971 | Schaff | 249/69 |
| 3,817,441 | 6/1974 | Jackson | 229/2.5 EC |

*Primary Examiner*—Davis T. Moorhead

*Attorney, Agent, or Firm*—Edward R. Weingram

[57] ABSTRACT

A carton of a suitable protective flexible plastic or plastic coated material includes a plurality of ovoid cavities for receiving eggs, each cavity having a plurality of communicating channels with tapered sides. The material provides a waterproof base to permit further use of the egg carton as an ice tray. The channels permit water flow between adjacent cavities and provide stress points to facilitate separation and removal of ice cubes formed in the cavities.

2 Claims, 3 Drawing Figures

COMBINED ICE TRAY EGG CARTON

BACKGROUND OF THE INVENTION

1. Field of the Invention

The present invention relates to egg cartons and particularly to one which is also usable as an ice tray.

2. Description of the Prior Art

Egg cartons made of plastic or plastic coated cardboard are known, as are plastic ice trays. The egg carton is used for carrying and protecting the eggs during various stages of shipment and transfer from the producer and seller to the consumer. After the eggs are removed, the carton is generally discarded. Typical plastic and carboard egg carton configurations are shown in U.S. Pats. Nos. 3,817,441 issued June 18, 1974 and 3,346,171 issued Oct. 10, 1967. Some egg cartons have connecting channels at the sides of particular walls separating adjacent ovoid cavities, while other groups of cavities are separated by walls having no channels. Ice trays for making ice cubes generally have a larger number of smaller rectangular shaped cavities with rectangular communicating channels through the walls to direct the flow of water between the upper edges of adjacent cavities. One such ice tray is shown in U.S. Pat. No. 3,620,497 issued Nov. 16, 1971. These presently available types, however, are not suitable for use as both an egg carton and an ice tray. Thus, egg cartons are generally used only once and then discarded as waste.

SUMMARY OF THE INVENTION

It is therefore the primary object of the present invention to provide a combined ice tray egg carton which, after initial use as an egg carton, can be saved and reused for making ice cubes.

This is achieved with a flexible plastic tray or base portion having a plurality of ovoid cavities for receiving eggs, each cavity having a plurality of communicating channels with tapered sides. The channels are preferably at a central location in the upper edges of the curved separating walls at the closest point between adjacent cavities to permit free flow of water. The channels have tapered or angled sides which may be in the range of 45° to 120° to provide stress raising points for facilitating the separation and removal of ice cubes. The cover may be connected to the base by thin flexible joints to permit easy detachment. Other objects and advantages will become apparent from the following description in conjunction with the accompanying drawings.

DESCRIPTION OF THE PREFERRED EMBODIMENT

Figure 1:
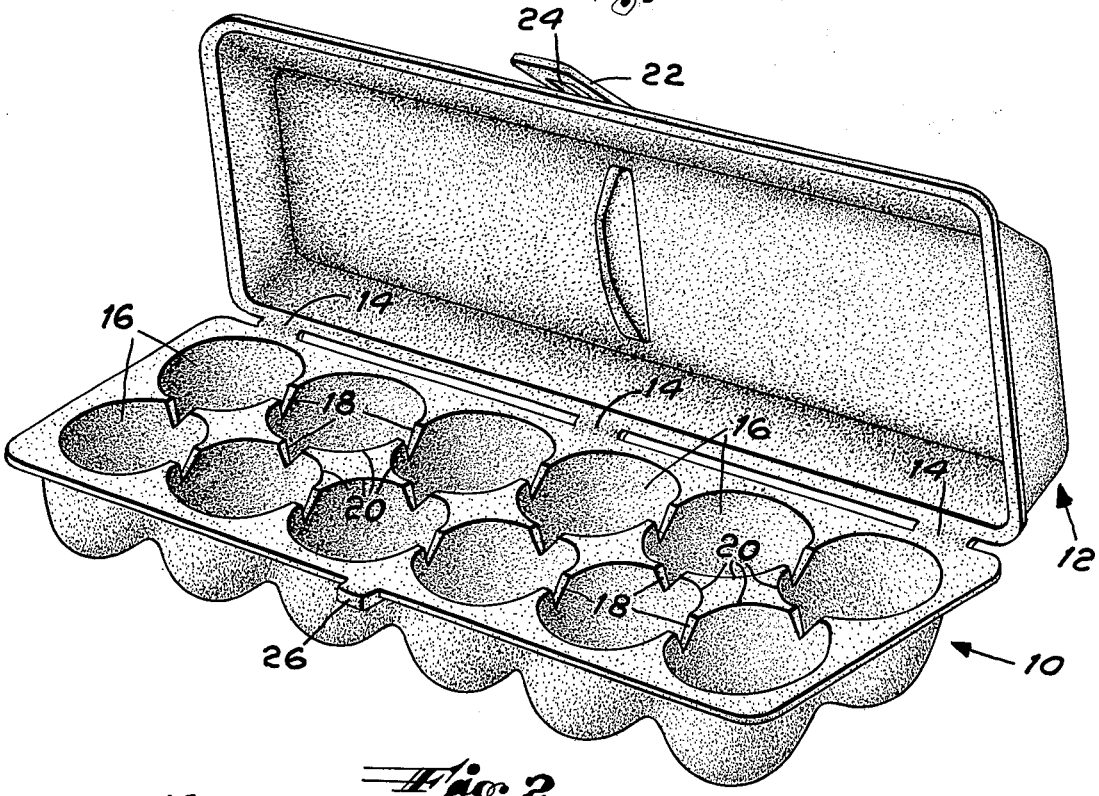
FIG. 1 is a pictorial representation showing an isometric view of the egg carton ice tray having communicating ovoid cavities.
Figure 2:
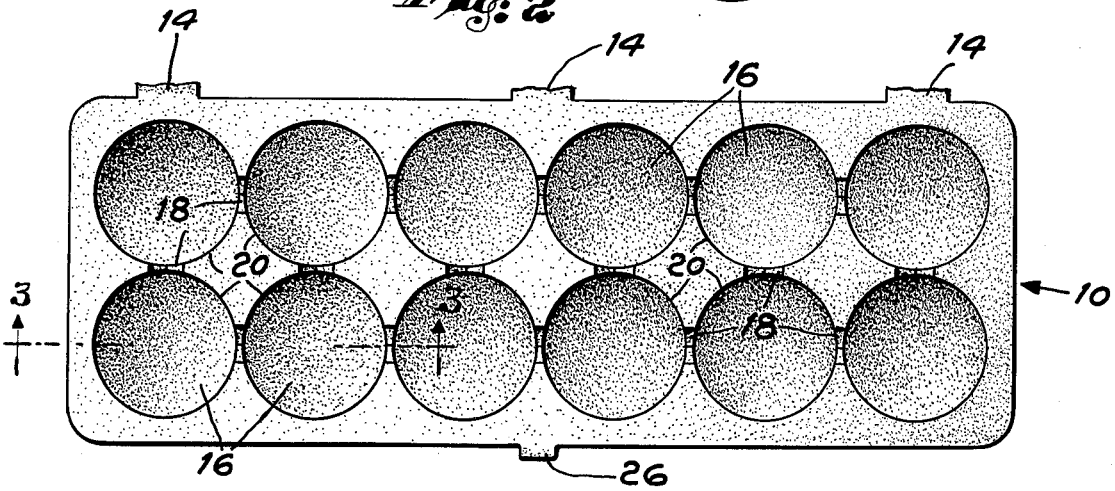
FIG. 2 is a top view of the base tray showing the cavities and communicating channels.

As shown in FIGS. 1 and 2, a combined egg carton ice tray includes a base tray portion 10 and a cover 12 movably secured thereto by thin flexible plastic connecting strips or joints 14 along one edge. The base includes a plurality of like ovoid recessions or cavities 16 open at the upper end to receive a plurality of eggs.

The cavities are arranged in two parallel rows of six each to accomodate one dozen eggs. Each cavity includes a plurality of communicating slots or channels 18 in central locations in the upper rims of the curved walls 20 separating the cavities at the closest spacing between adjacent cavities.

The carton is preferably made of a suitable soft pliant plastic material which is waterproof, such as a foamed polystyrene. The material provides protection for the eggs as well as a water impervious surface for making ice cubes. The cover includes a suitable locking member 22 having an opening 24 which engages a projection 26 on the outer edge of the base, to hold the carton closed when filled with eggs. When the eggs are removed, the cover may be easily detached by tearing or cutting the thin joints 14.

Figure 3:
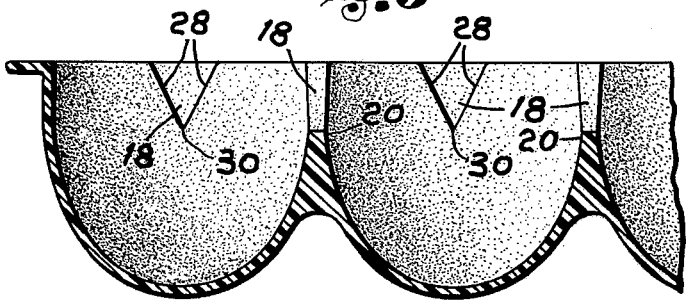
FIG. 3 is a partial front cross-sectional view along line 3—3 of FIG. 2 showing a group of cavities with communicating angled channels.

As shown in FIG. 3, the channels 18 have tapered or angled sides 28 in the form of V-shaped slots, preferably in the range of from 45° to 120°, with a relatively sharp tip 30. When the tray is filled with water for making ice cubes, the channels permit free flow of the water between the upper rims of adjacent cavities to provide relatively even distribution and water levels in the various cavities. The tray is placed in a suitable freezer to freeze the water into ice cubes. When the tray of ice cubes is removed, the sharp angled channels provide stress raising points which facilitate breaking and separation of any frozen joints between cubes. A slight flexing of the plastic tray applies pressure to the ice in the cavities and channels to simplify removal of the cubes which have a unique semi-ovoid shape with rounded bottoms and a flat circular upper edge.

The present invention thus provides a novel reusable combined ice tray egg carton. While only a single embodiment has been illustrated and described, it is apparent that many variations may be made in the particular design and configuration without departing from the scope of the invention as set forth in the appended claims.

What is claimed is:

1. A container comprising:

a flexible water impervious rectangular base portion having a plurality of ovoid cavities and curved walls of substantially uniform depth separating adjacent cavities to form two parallel rows of six cavities adapted to receive one dozen eggs;

each cavity including a plurality of tapered channels in the upper edges of said walls positioned in said curved walls at the closest spacing between adjacent cavities communicating with adjacent cavities; said channels being in the form of v-shaped slots, the sides of said slots being tapered at an angle of between 45° and 120°, the full cross section of said slots including the sharp lower tips extending completely through said walls into said adjacent cavities, said cavities being adapted to receive water to be frozen to ovoid shaped ice cubes and said slots being adapted to direct water between adjacent cavities and providing stress points for separation and removal of said ice cubes;

a cover movably secured along one edge of said base; and, locking means disposed on said cover and said base disposed on the edge of said base and cover opposite the edge of said cover movably secured to said base.

2. The container of claim 1 wherein said base is of a soft flexible plastic material.

* * * * *